US006190142B1

(12) United States Patent
Wu

(10) Patent No.: US 6,190,142 B1
(45) Date of Patent: Feb. 20, 2001

(54) MANUAL AIR PUMPS HAVING SELECTABLE HIGH PRESSURE AND HIGH PRESSURE MODES

(76) Inventor: Scott Wu, P.O. Box 63-247, Taichung (TW)

( * ) Notice: Under 35 U.S.C. 154(b), the term of this patent shall be extended for 0 days.

(21) Appl. No.: 09/333,942

(22) Filed: Jun. 16, 1999

(51) Int. Cl.[7] ..... F04B 3/00; F04B 53/00
(52) U.S. Cl. ..... 417/523; 417/259
(58) Field of Search ..... 417/523, 521, 417/437, 259, 258, 254, 244

(56) References Cited

U.S. PATENT DOCUMENTS

| | | | | |
|---|---|---|---|---|
| 817,538 | * | 4/1906 | Wixon | 417/258 |
| 1,187,835 | * | 6/1916 | Hill et al. | 417/258 |
| 1,412,279 | * | 4/1922 | Eslinger | 417/258 |
| 1,424,928 | * | 8/1922 | McClelland | 417/258 |
| 5,051,073 | * | 9/1991 | Newbold | 417/526 |
| 5,165,876 | * | 11/1992 | Wang | 417/511 |
| 5,443,370 | * | 8/1995 | Wang | 417/238 |
| 5,676,529 | * | 10/1997 | Hermansen et al. | 417/259 |
| 5,997,256 | * | 12/1999 | Gunther | 417/259 |

* cited by examiner

*Primary Examiner*—Teresa Walberg
*Assistant Examiner*—Daniel Robinson

(74) *Attorney, Agent, or Firm*—Rosenberg, Klein & Lee

(57) ABSTRACT

A manual air pump includes an outer tube and an inner tube coaxially mounted in the outer tube. An inner chamber is defined in the inner tube. An outer chamber is defined between the outer tube and the inner tube. A head is coupled to first ends of the inner and outer tubes. The head includes a main passage communicated with the inner chamber and the outer chamber for supplying air to an object to be inflated. An inner piston rod has a first end with an inner piston slidably received in the inner chamber. The inner piston separates the inner chamber into a first chamber section adjacent to the head and a second chamber section distal to the head. An outer piston rod has a first end with an outer piston slidably received in the outer chamber. The outer piston separates the outer chamber into a third chamber section adjacent to the head and a fourth chamber section distal to the head. A handle is secured to second ends of the inner and outer piston rods to move therewith. A release passage is provided for communicating one of the first chamber section and the third chamber section with environment. A switchable valve is mounted in the release passage, wherein the release passage is blocked when the switchable valve is in a first status for high volume/low pressure pumping, and wherein the release passage is opened when the switchable valve is in a second status for high pressure/low volume pumping in which air is only flowable from the one of the first chamber section and the third chamber section to environment.

15 Claims, 16 Drawing Sheets

MANUAL AIR PUMPS HAVING SELECTABLE HIGH PRESSURE AND HIGH PRESSURE MODES

BACKGROUND OF THE INVENTION

1. Field of the Invention

The present invention relates to manual air pumps for inflating, e.g., bicycle tires, and more particularly to dual-mode manual air pumps that may in one mode provide a very high volume of air per stroke and in another mode provide less volume of air at high pressure.

2. Description of the Related Art

Bicycle pumps, as mentioned in U.S. Pat. No. 5,676,529 to Hermansen et al. issued on Oct. 14, 1997, include two typical types: 1) big bore for high volume per stroke and low pressure for rapid inflation, yet high pressure operation is difficult to achieve; and 2) small bore for low volume per stroke and high pressure for inflating bicycle tires to high pressure. Hermansen et al. proposes a compact manual pump having selectable high volume and high pressure modes, wherein the pump in one mode provides a very high volume of air per pump stroke and in another mode provides less volume per stroke but enables the user to inflate to higher pressures. Nevertheless, in the output stroke shown in FIG. 4 of U.S. Pat. No. 5,676,529, air from the rear chamber defined between the outer tube 12 and the inner tube 24 must pass through the interior of the inner tube 24 before it enters a front chamber defined in the middle cylindrical tube 14. It is found that high pressure inflation is not reliable and unsatisfactory.

The present invention is intended to provide manual air pumps that mitigate and/or obviate the above problem.

SUMMARY OF THE INVENTION

A manual air pump in accordance with the present invention comprises:

an outer tube including a first end and a second end, an inner tube coaxially mounted in the outer tube and including a first end and a second end, an inner chamber being defined in the inner tube, an outer chamber being defined between the outer tube and the inner tube, a head coupled to the first end of the outer tube and the first end of the inner tube, the head including a main passage communicated with the inner chamber and the outer chamber for supplying air to an object to be inflated, a piston assembly including:

an inner piston rod having a first end with an inner piston slidably received in the inner chamber and a second end, the inner piston separating the inner chamber into a first chamber section adjacent to the head and a second chamber section distal to the head, an outer piston rod having a first end with an outer piston slidably received in the outer chamber and a second end, the outer piston separating the outer chamber into a third chamber section adjacent to the head and a fourth chamber section distal to the head, and a handle secured to the second end of the inner piston rod and the second end of the outer piston rod to move therewith, means for supplying ambient air into the second chamber section and the fourth chamber section during an outward stroke of the handle away from the head, a release passage for communicating one of the first chamber section and the third chamber section with environment, and switchable valve means mounted in the release passage, wherein the release passage is blocked when the switchable valve means is in a first status, and wherein the release passage is opened when the switchable valve means is in a second status such that air is only flowable from said one of the first chamber section and the third chamber section to environment.

The head includes a passage through which air is flowable from the first chamber section to the main passage, and a one-way valve is mounted in the passage such that air is only flowable from the first chamber section to the main passage.

The head may further includes a passage through which air is flowable from the third chamber section to the main passage, and a one-way valve is mounted in the passage such that air is only flowable from the third chamber section to the main passage.

The inner piston includes an annular groove defined in an outer periphery thereof and including a first end edge and a second end edge. An O-ring is mounted in the annular groove and so arranged that an air path is defined to allow air to flow from the second chamber section to the first chamber section when the O-ring abuts against the first end edge of the annular groove as a result of the outward stroke of the handle away from the head and that the air path is blocked when the O-ring abuts against the second edge of the annular groove as a result of an inward stroke of the handle toward the head.

The outer piston includes an annular groove defined in an outer periphery thereof and having a first end edge and a second end edge. An O-ring is mounted in the annular groove and so arranged that an air path is defined to allow air to flow from the fourth chamber section to the second chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

The air supplying means includes a first passage defined between the second end of the outer tube and the outer piston rod, a second passage defined between the second end of the inner tube and the inner tube, and an opening defined in the second end of the outer piston rod.

In a first embodiment of the invention, the release passage is defined in the head and communicates the first chamber section with environment. The switchable valve means includes a one-way valve and an elastic member mounted in the release passage and a manually operable switch key for switching the switchable valve means between the first status and the second status.

In a second embodiment of the invention, the outer tube includes an extension tube extended from an outer periphery thereof, the release passage is defined in the extension tube that communicates the third chamber section with environment. The switchable valve means includes a one-way valve and a first elastic member mounted in the extension tube, a sleeve mounted around the extension tube and enclosing a distal end of the extension tube, and a valve stem slidably received in the extension tube and having an end extended beyond the sleeve for manual operation between the first status and the second status. The sleeve further includes a notch. The valve stem includes a block. The notch of the sleeve is blocked by the block of the valve stem when the switchable valve means is in the first status such that air in the fourth chamber section is not flowable to environment. The notch is not blocked by the block of the valve stem when the switchable valve means is in the second status such that air in the fourth chamber section is flowable to environment during an inward stroke of the handle.

In a third embodiment of the invention, the inner piston rod includes a hollow interior communicated with environment, and the release passage is defined in the inner piston and communicates the first chamber section with the hollow interior of the inner piston rod. The switchable valve means includes a one-way valve mounted in the release passage and an operative rod having a first end operably connected to the one-way valve and a second end extended beyond the handle for manual operation. The one-way valve is closed when the operative rod is in a first position. The one-way valve is opened when the operative rod is in a second position such that the hollow interior of the inner piston rod communicates with environment and that air is only flowable from the first chamber section to the hollow interior of the inner piston rod.

In a fourth embodiment of the invention, a mediate chamber is defined between the outer piston rod and the inner tube, the mediate chamber being communicated with environment via a chamber defined between the outer piston rod and the inner piston rod. The release passage is defined in the outer piston and communicates the third chamber section with the mediate chamber. The switchable valve means includes a one-way valve mounted in the release passage and an operative rod having a first end operably connected to the one-way valve and a second end extended beyond the handle for manual operation. The one-way valve is closed when the operative rod is in a first position. The one-way valve is opened when the operative rod is in a second position such that air is only flowable from the third chamber to the mediate chamber.

Thus, reliable dual-mode manual air pumps are provided, and operations therefor are simple.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
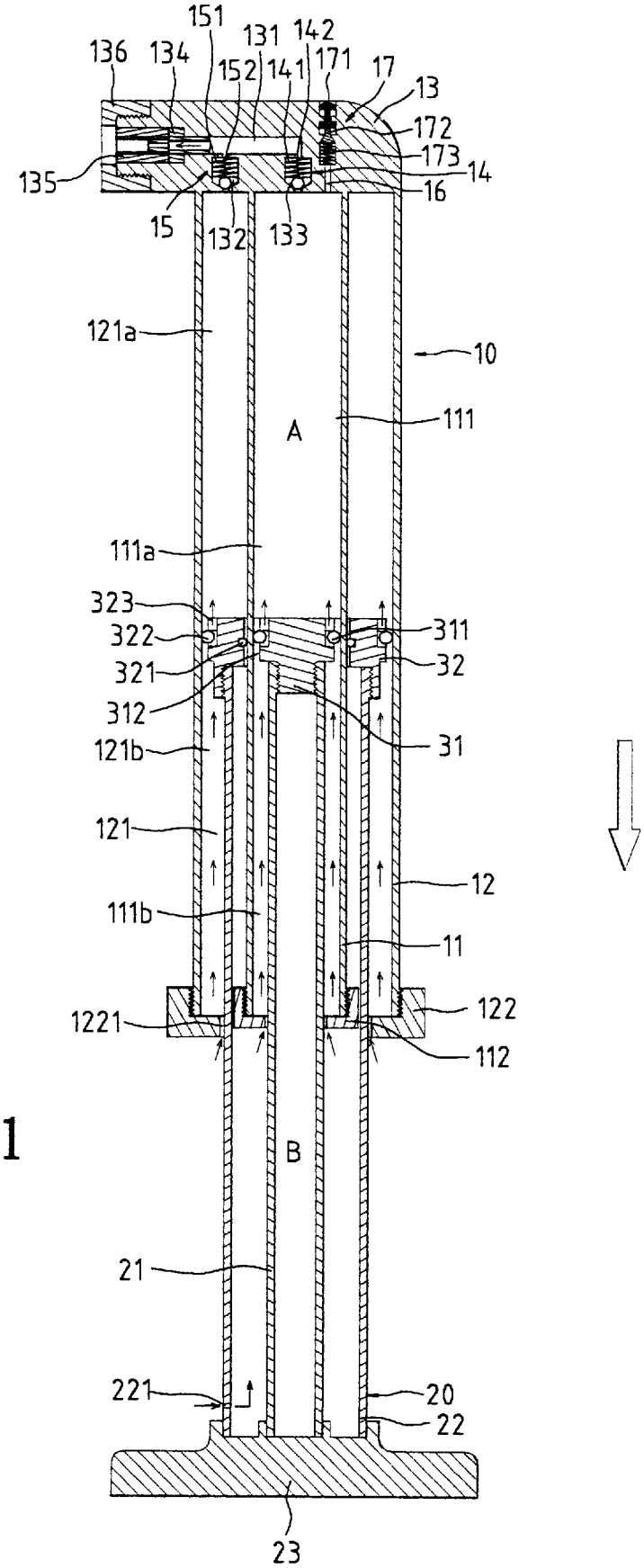
FIG. 1 is a sectional view of a first embodiment of a manual air pump in accordance with the present invention, wherein the handle of the pump is in an outward stroke for high-volume pumping.

Referring to the drawings and initially to FIG. 1, a manual hand pump 10 in accordance with the present invention generally includes an outer tube 12 and an inner tube 11 coaxially mounted in the outer tube 12. An inner chamber 111 is defined in the inner tube 11 and an outer chamber 121 is defined between the outer tube 12 and the inner tube 11. A head 13 is coupled to a first end of the outer tube 12 and a first end of the inner tube 11. The head 13 includes a main passage 131 communicated with the inner chamber 111 and the outer chamber 121 for supplying air to an object to be inflated. In this embodiment, a nozzle 134 and a nozzle plug 135 are mounted in the main passage 131, and an end cap 136 is provided to secure the nozzle 134 and nozzle plug 135 in place. A passage 132 is provided to communicate the outer chamber 121 with the main passage 131, and a one-way valve 15 (including an elastic member 151 and a ball 152) is mounted in the passage 132 such that air is only flowable from the outer chamber 121 to the main passage 131. Similarly, a passage 133 is provided to communicate the inner chamber 111 with the main passage 131, and a one-way valve 14 (including an elastic member 141 and a ball 142) is mounted in the passage 133 such that air is only flowable from the inner chamber 111 to the main passage 131.

The manual hand pump further includes a piston assembly 20 that comprises an inner piston rod 21 having a first end with an inner piston 31 slidably received in the inner chamber 111 and a second end. The inner piston 31 separates the inner chamber 111 into a first chamber section 111*a* adjacent to the head 13 and a second chamber section 111*b* distal to the head 13. The piston assembly 20 further includes an outer piston rod 22 having a first end with an outer piston 32 slidably received in the outer chamber 121 and a second end. The outer piston 32 separates the outer chamber 121 into a third chamber section 121*a* adjacent to the head 13 and a fourth chamber section 121*b* distal to the head 13. A handle 23 is secured to the second ends of the inner piston rod 21 and the outer piston rod 22 to move therewith.

Figure 4:
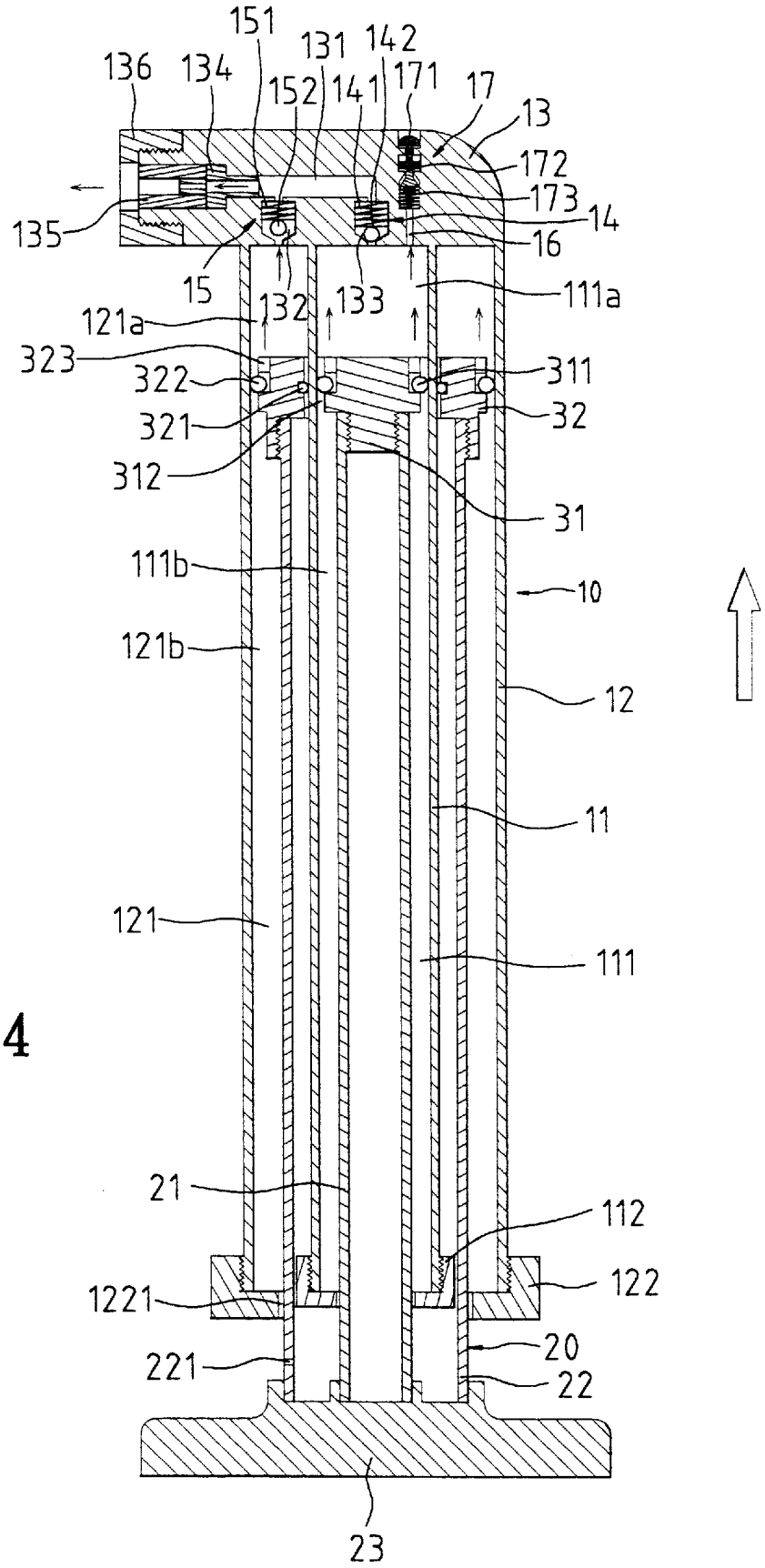
FIG. 4 is a sectional view similar to FIG. 3, wherein the handle of the pump is in an inward stroke for high-pressure pumping.
Figure 7:
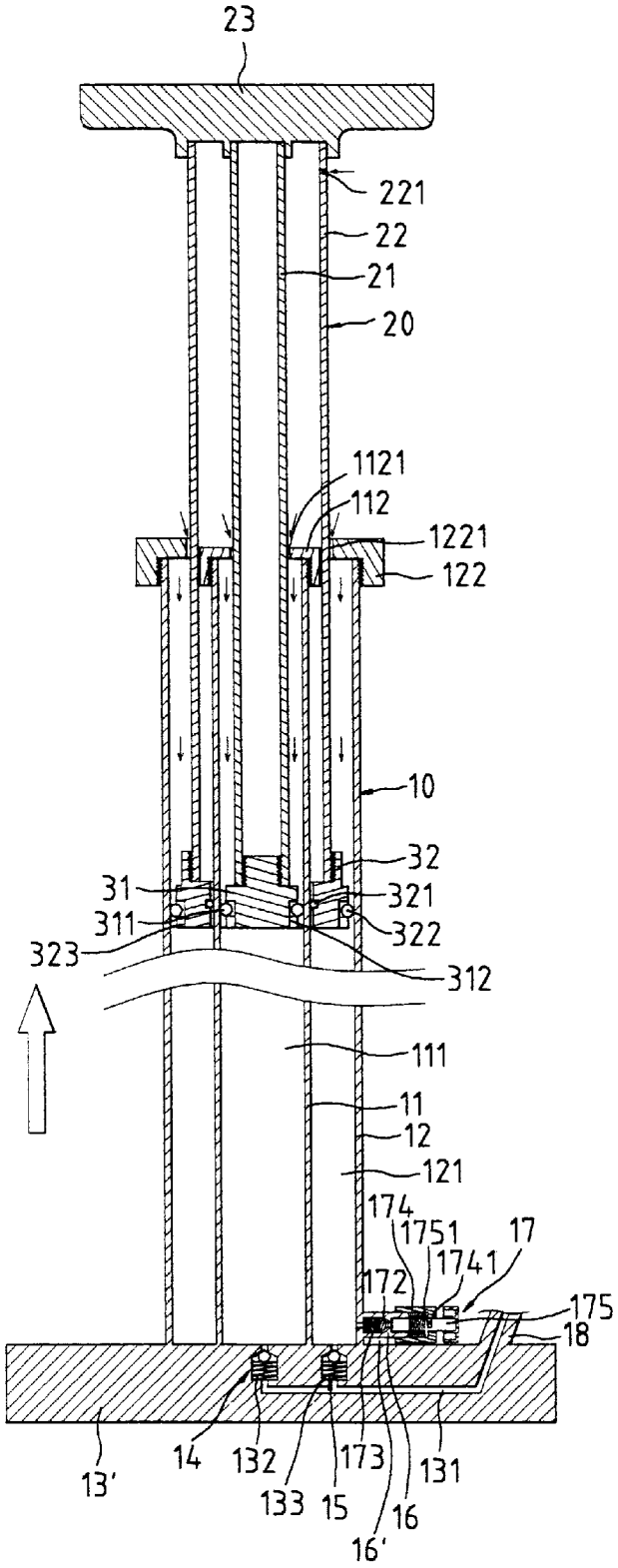
FIG. 7 is a sectional view similar to FIG. 5, wherein the handle of the pump is in an outward stroke for high-pressure pumping.

The inner piston 31 includes an O-ring 311 mounted in an annular groove 312 defined in an outer periphery thereof. The O-ring 311 and the annular groove 312 are so arranged that a first air path (not labeled) is defined to allow air to flow from chamber section 111*b* to chamber section 111*a* when the O-ring 311 abuts against an upper edge of the annular groove 312 and that the first air path is blocked (i.e., chamber section 111*a* is not communicated with chamber section 111*b*) when the O-ring 311 abuts against a lower edge of the annular groove 312. An O-ring 321 is mounted in an inner periphery of the outer piston 32 to provide a sealing effect. The outer piston 32 further includes an O-ring 322 mounted in an annular groove 323 in an outer periphery thereof. The O-ring 322 and the annular groove 323 are so arranged that a second air path (not labeled) is defined to allow air to flow from chamber section 121*b* to chamber section 121*a* when the O-ring abuts against an upper edge of the annular groove 323 and that the second air path is blocked (i.e., chamber section 121*a* is not communicated with chamber section 121*b*) when the O-ring 322 abuts against a lower edge of the annular groove 323. Example of such piston is shown in FIGS. 4 and 7 of U.S. Pat. No. 5,873,705 issued on Feb. 23, 1999, which is incorporated herein for reference.

Air supplying means is provided for supplying ambient air into the second chamber section 111*b* and the fourth chamber section 121*b* during an outward stroke of the handle 23 away from the head 13. In this embodiment, the air supplying means includes a first passage 1221 defined between the second end of the outer tube 12 (to which an outer end cap 122 is attached) and the outer piston rod 22, a second passage 1121 defined between the second end (to which an inner end cap 112 is attached) of the inner tube 12 and the inner piston rod 21, and an opening 221 defined in the second end of the outer piston rod 22.

In addition, a release passage 16 is defined in the head 13 for communicating the inner chamber 111 with environment. A switchable valve means 17 is mounted in the release passage 16. The release passage 16 is blocked when the switchable valve means 17 is in a first status, and the release passage 16 is opened when the switchable valve means 17 is in a second status such that air is only flowable from the inner chamber 111 to environment. The switchable valve means 17 includes a manually operable switch key 171, a one-way valve 172, and an elastic member 173. The above-mentioned statuses of the switchable valve means 17 are alternatively switchable by means of operating the switch key 171.

Figure 2:
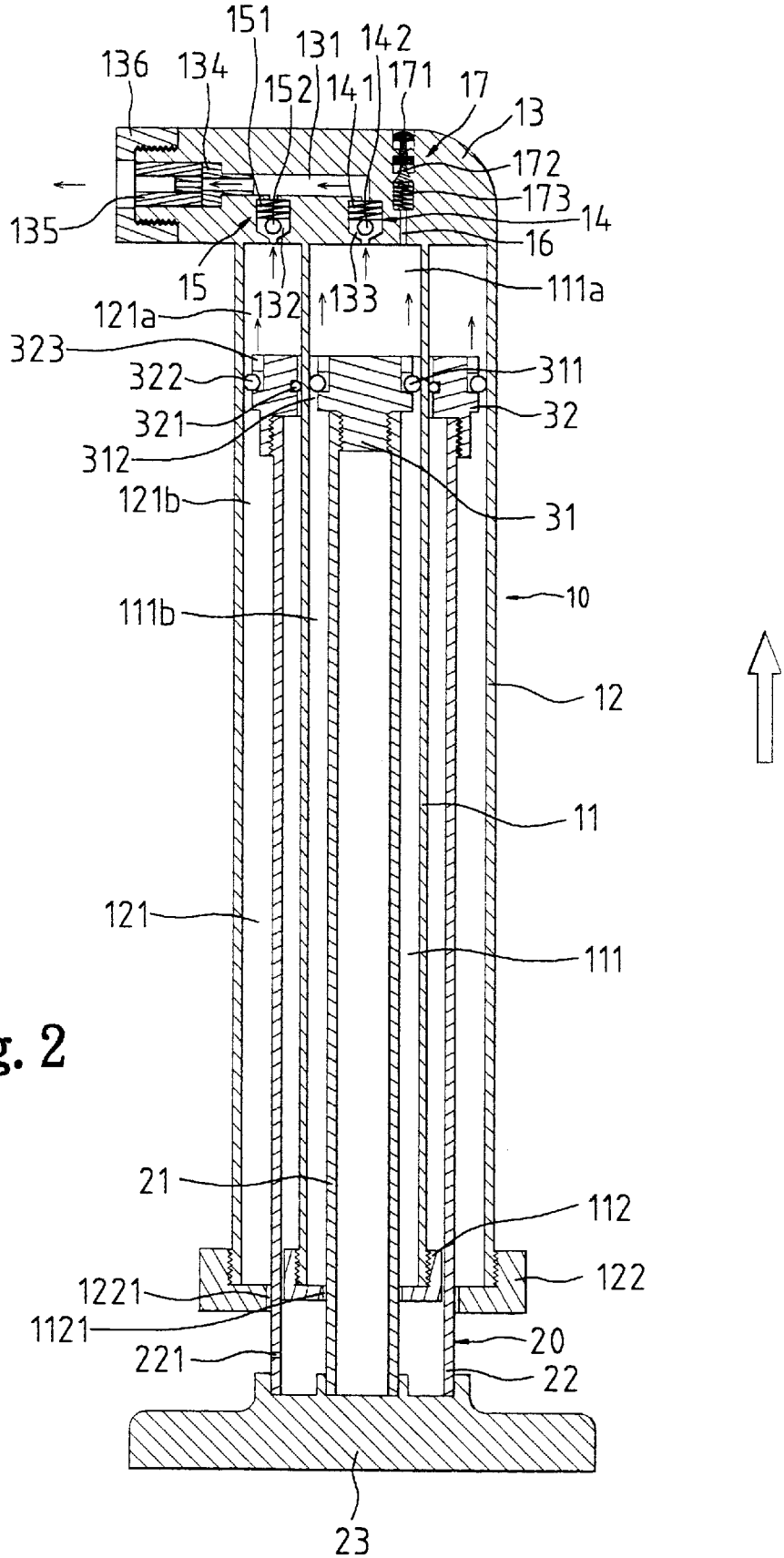
FIG. 2 is a sectional view similar to FIG. 1, wherein the handle of the pump is in an inward stroke for high-volume pumping.

The switchable valve means 17 of the pump in FIG. 1 is in the first status and the release passage 16 is blocked. During the outward stroke of the handle 23, O-ring 322 abuts against the upper edge of the annular groove 323 and O-ring 311 abuts against the upper edge of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 1. During the inward stroke of the handle 23, O-ring 322 abuts against the lower edge of the annular groove 323 and O-ring 311 abuts against the lower edge of the annular groove 312 such that air is not flowable from chamber sections 121*b* and 111*b* to chamber sections 121*a* and 111*a*. Thus, air in chamber sections 121*a* and 111*a* is outputted via the main passage 131 in the head 13 during the inward stroke of the handle 23, best shown in FIG. 2. Accordingly, high volume/low pressure inflation is achieved. Ambient air enters chamber sections 121*b* and 111*b* during the inward stroke of the handle 23 for subsequent outward stroke of the handle 23.

Figure 3:
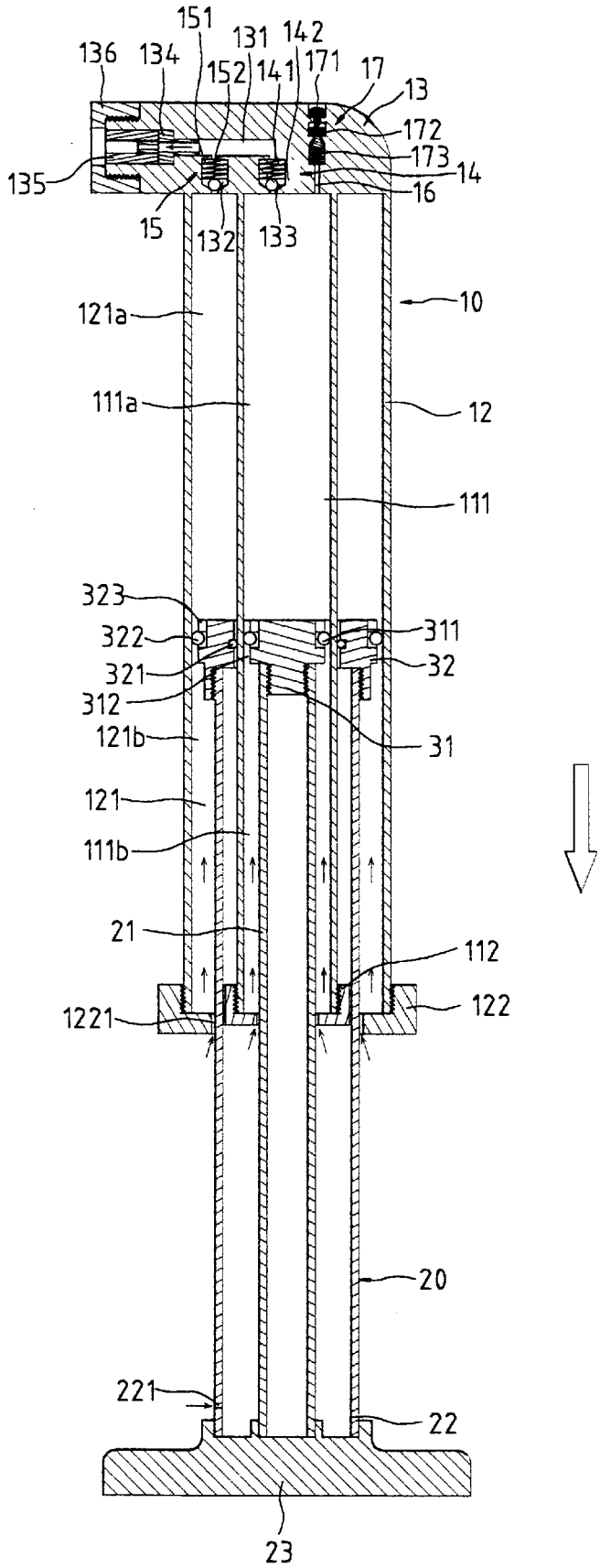
FIG. 3 is a sectional view similar to FIG. 1, wherein the handle of the pump is in an outward stroke for high-pressure pumping.

The switchable valve means 17 of the pump in FIG. 3 is in the second status and the release passage 16 is opened. During the outward stroke of the handle 23, O-ring 322 abuts against the upper edge of the annular groove 323 and O-ring 311 abuts against the upper edge of the annular groove 312 such that air is flowable from chamber sections 121*b* and 111*b* to chamber sections 121*a* and 111*a*. In addition, vacuum in chamber sections 121*a* and lla as a result of a previous inward stroke of the handle 23 assists in intake of air. Thus, ambient air enters chamber sections 121*a* and 111*a* during the outward stroke of the handle 23, best shown in FIG. 3. During the inward stroke of the handle 23, O-ring 322 abuts against the lower edge of the annular groove 323 and O-ring 311 abuts against the lower edge of the annular groove 312 such that air is not flowable from chamber sections 121*b* and 111*b* to chamber sections 121*a* and 111*a*. Thus, air in chamber section 121*a* is outputted via the main passage 131 in the head 13 during the inward stroke of the handle 23, best shown in FIG. 4. Nevertheless, air in chamber section 111*a* exits the pump via the valve means 17. Thus, low volume/high pressure inflation is achieved. Ambient air enters chamber sections 121*b* and 111*b* during the inward stroke of the handle 23 for subsequent outward stroke of the handle 23.

Figure 5:
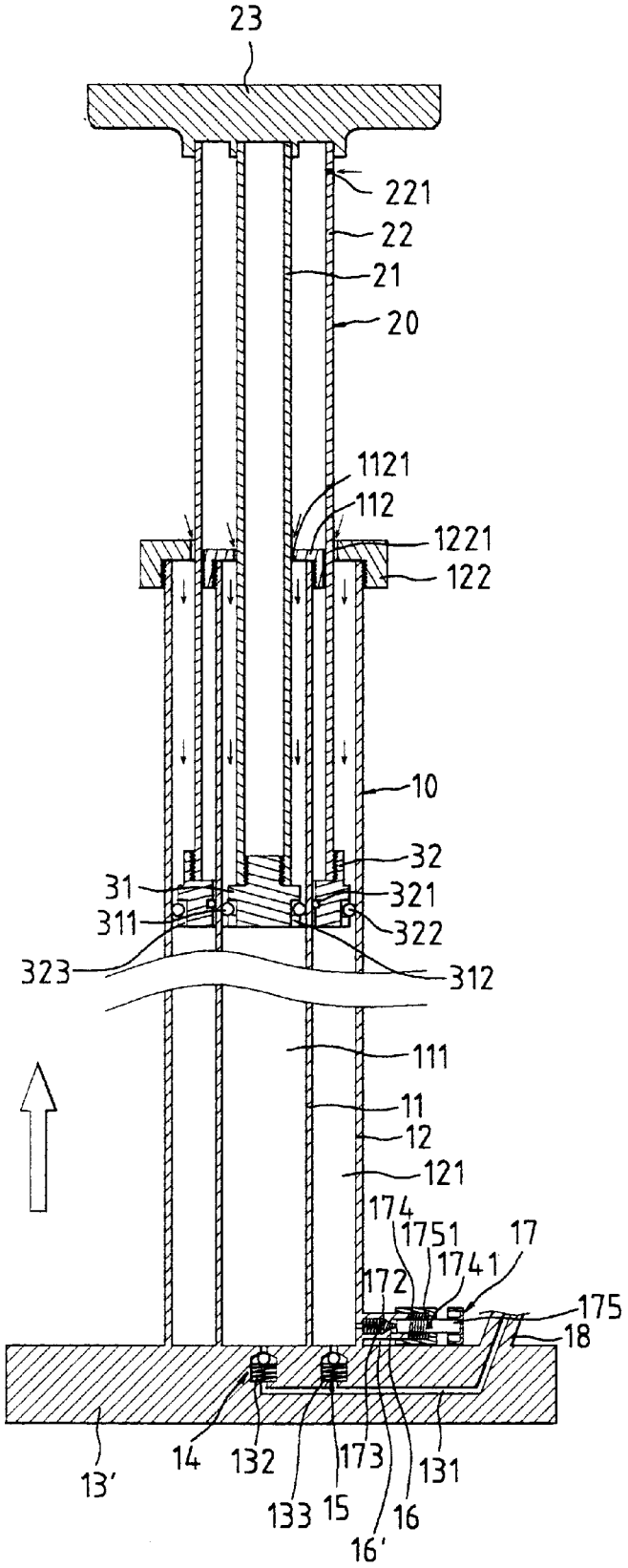
FIG. 5 is a sectional view of a second embodiment of the manual air pump in accordance with the present invention, wherein the handle of the pump is in an outward stroke for high-volume pumping.

FIG. 5 illustrates a second embodiment of the manual air pump. Structure of the second embodiment is substantially the same as that of the first embodiment except for arrangement in the release passage 16 and the valve means 17. In this embodiment, the outer tube 12 includes an extension tube 16' extended from an outer periphery thereof. The release passage 16 is defined in the extension tube 16' that communicates the third chamber section 121*a* with environment. In addition to the one-way valve 172 and the elastic member 173 mounted in the extension tube 16', the valve means 17 includes a sleeve 174 mounted around the extension tube 16' and enclosing a distal end of the extension tube 16', a valve stem 175 slidably received in the extension tube 16' and having an end extended beyond the sleeve 174 for manual operation, and an elastic member 173 mounted in the extension tube 16' and around the valve stem 175. The sleeve 174 further includes a notch 1741. The valve stem 175 includes a block 1751 that may block the notch 1741. The elastic member 173 biases the block 1751 to block the notch 1741, thereby achieving a sealing status. If the valve stem 175 is pushed inward, the block 1751 disengages from the notch 1741. The valve stem 175 may be rotated through an angle and then released, such that the block 1751 on the valve stem 175 is retained by an end wall of the sleeve 174. As a result, air from the chamber section 121*a* exits the pump via the notch 1741. Reference numeral "18" denotes an output of the manual air pump of the type that may "stand" on the ground during operation, which is conventional and therefore not described in detail.

Figure 6:
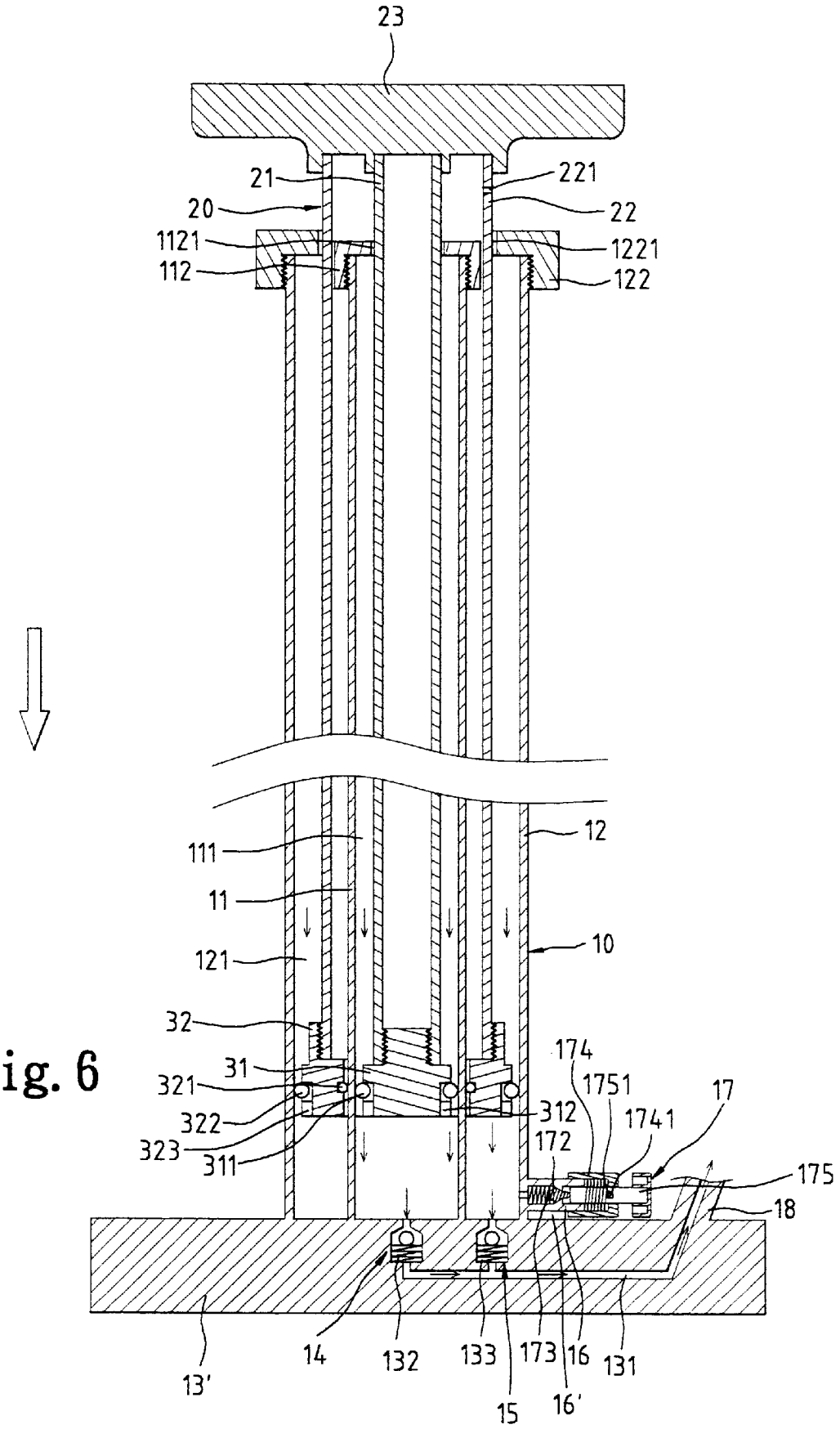
FIG. 6 is a sectional view similar to FIG. 5, wherein the handle of the pump is in an inward stroke for high-volume pumping.

The switchable valve means 17 of the pump in FIG. 5 is in the first status and the release passage 16 is blocked. During the outward stroke of the handle 23, O-ring 322 abuts against the upper edge (lower edge in FIG. 5) of the annular groove 323 and O-ring 311 abuts against the upper edge (lower edge in FIG. 5) of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 5. During the inward stroke of the handle 23, O-ring 322 abuts against the lower edge (upper edge in FIG. 6) of the annular groove 323 and O-ring 311 abuts against the lower edge (upper edge in FIG. 6) of the annular groove 312 such that air is not flowable from chamber sections 121*b* and 111*b* to chamber sections 121*a* and 111*a*. Thus, air in chamber sections 121*a* and 111*a* is outputted via the main passage 131 in the head 13 during the inward stroke of the handle 23, best shown in FIG. 6. Accordingly, high volume/low pressure inflation is achieved. Ambient air enters chamber sections 121*b* and 111*b* during the inward stroke of the handle 23 for subsequent outward stroke of the handle 23.

Figure 8:
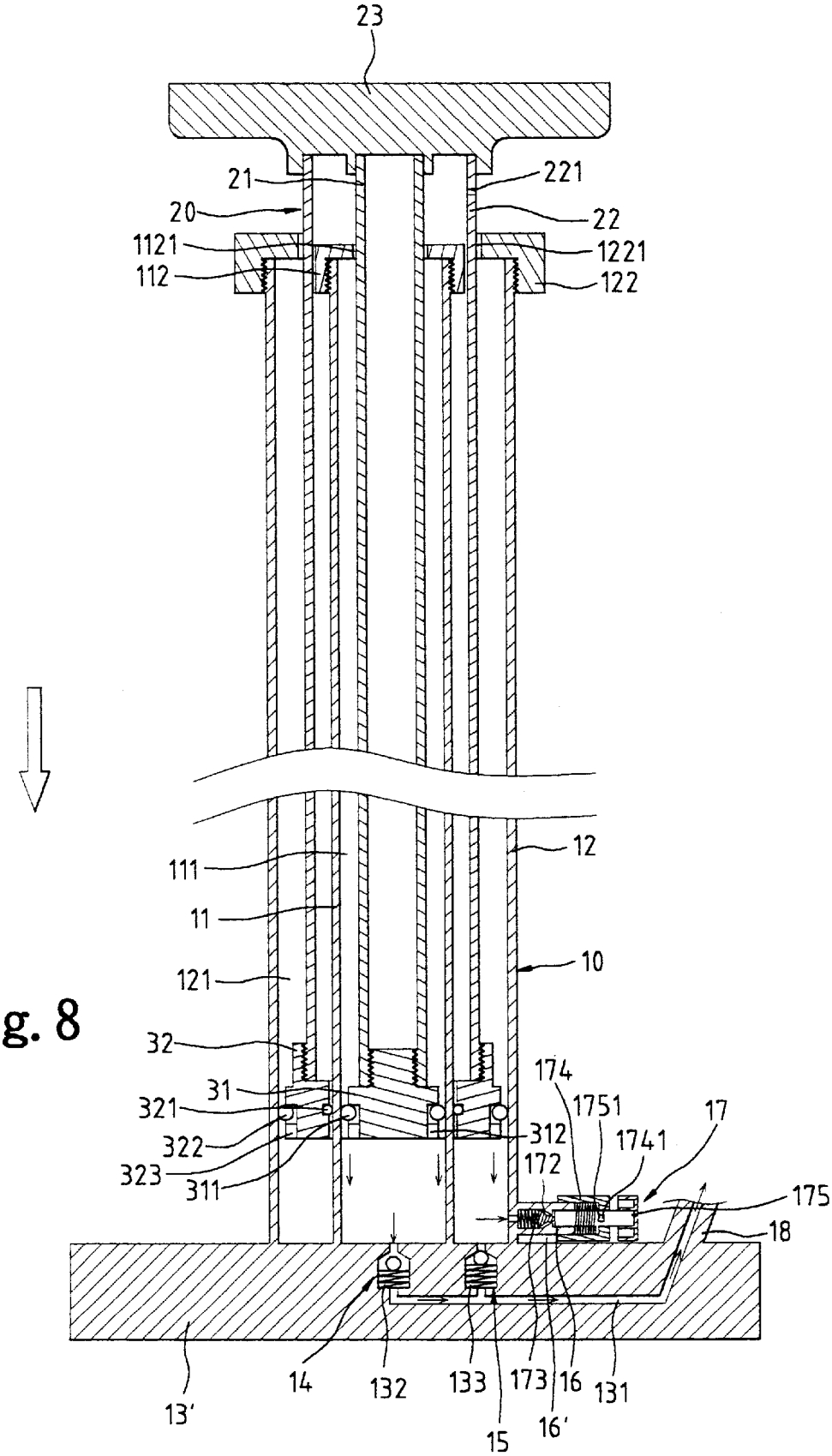
FIG. 8 is a sectional view similar to FIG. 7, wherein the handle of the pump is in an inward stroke for high-pressure pumping.

The switchable valve means 17 of the pump in FIG. 7 is in the second status (upon operating the valve stem 175) and the release passage 16 is opened. During the outward stroke of the handle 23, O-ring 322 abuts against the upper edge (lower edge in FIG. 7) of the annular groove 323 and O-ring 311 abuts against the upper edge (lower edge in FIG. 7) of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 7. During the inward stroke of the handle 23, O-ring 322 abuts against the lower edge (upper edge in FIG. 8) of the annular groove 323 and O-ring 311 abuts against the lower edge (upper edge in FIG. 8) of the annular groove 312 such that air is not flowable from chamber sections 121*b* and 111*b* to chamber sections 121*a* and 111*a*. Thus, air in chamber section 111*a* is outputted via the main passage 131 in the head 13 during the inward stroke of the handle 23, best shown in FIG. 8. Nevertheless, air in chamber section 12 la exits the manual pump via the valve means 17. Thus, low volume/high pressure inflation is achieved. Ambient air enters chamber sections 121*b* and 111*b* during the inward stroke of the handle 23 for subsequent outward stroke of the handle 23.

Figure 9:
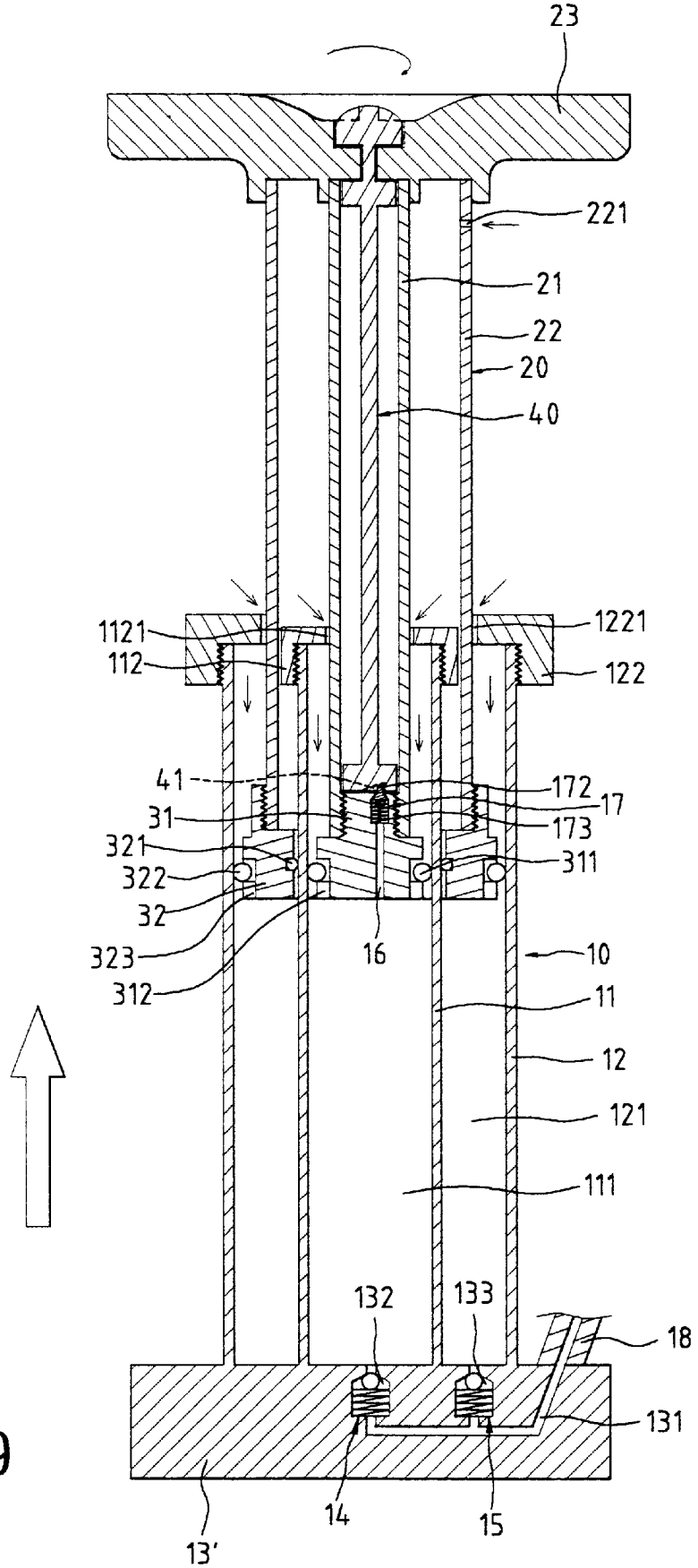
FIG. 9 is a sectional view of a third embodiment of the manual air pump in accordance with the present invention, wherein the handle of the pump is in an outward stroke for high-volume pumping.

FIG. 9 illustrates a third embodiment of the manual air pump. Structure of the third embodiment is substantially the same as that of the second embodiment except for arrangement in the release passage 16 and the valve means 17. In this embodiment, the release passage 16 is defined in the inner piston 31 and communicates the first chamber section 111*a* with hollow interior of the inner piston rod 21. In addition to the one-way valve 172 and the elastic member 173 mounted in the release passage 16, the valve means 17 includes an operative rod 40 having a first end operably connected to the one-way valve 172 and a second end extended beyond the handle 23 for manual operation. The one-way valve 172 is closed when the operative rod 40 is in a first position. The one-way valve 172 is opened when the operative rod 40 is in a second position such that the hollow interior of the inner piston rod 21 communicates with environment and that air is only flowable from the first chamber section 111*a* to the hollow interior of the inner piston rod 31.

Figure 10:
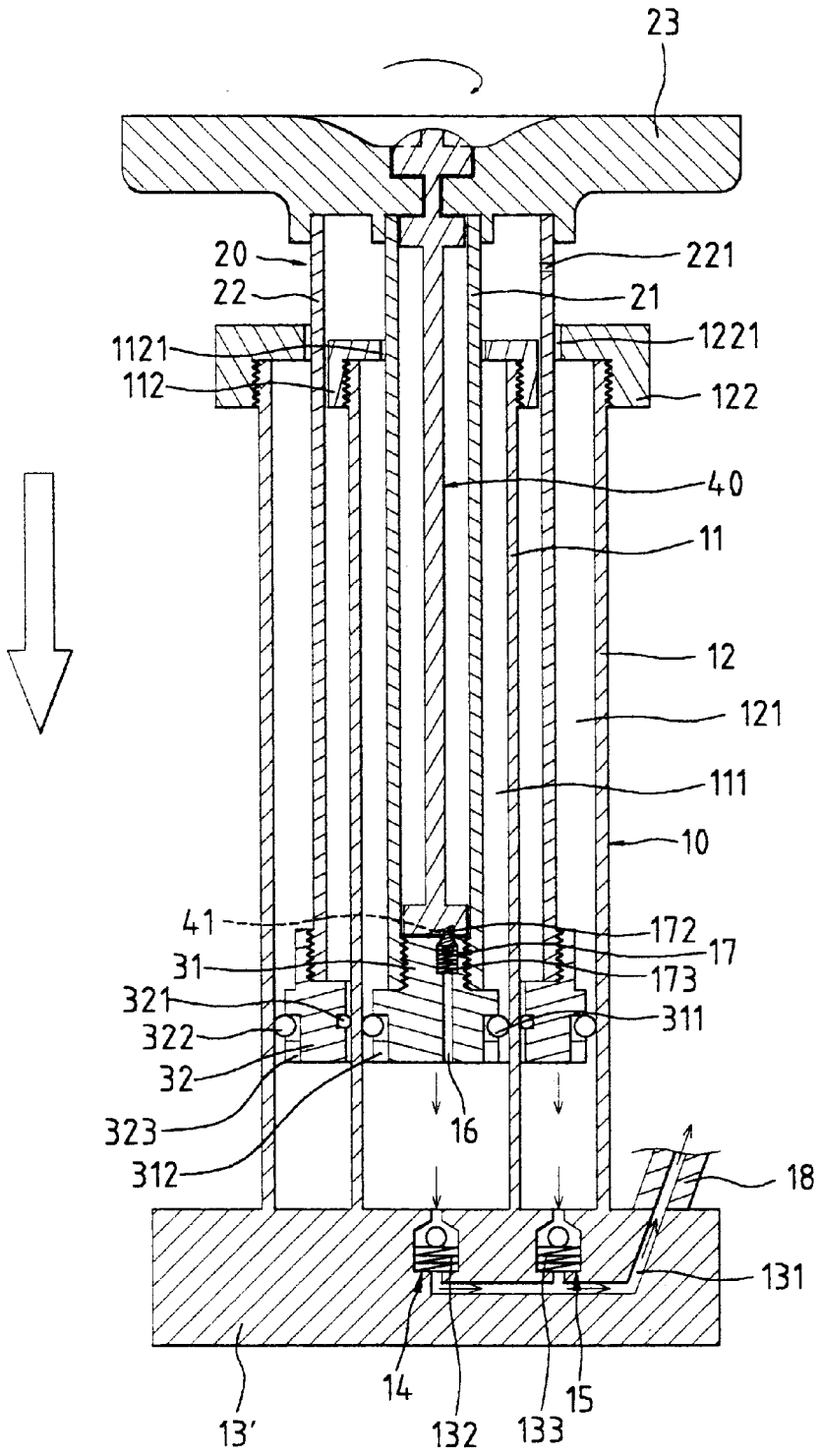
FIG. 10 is a sectional view similar to FIG. 9, wherein the handle of the pump is in an inward stroke for high-volume pumping.

The switchable valve means 17 of the pump in FIG. 9 is in the first status and the release passage 16 is blocked. During the outward stroke of the handle 23, O-ring 322 abuts against the upper edge (lower edge in FIG. 9) of the annular groove 323 and O-ring 311 abuts against the upper edge (lower edge in FIG. 9) of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 9. During the inward stroke of the handle 23, O-ring 322 abuts against the lower edge (upper edge in FIG. 10) of the annular groove 323 and O-ring 311 abuts against the lower edge (upper edge in FIG. 10) of the annular groove 312 such that air is not flowable from chamber sections 121*b* and 111*b* to chamber sections 121*a* and 111*a*. Thus, air in chamber sections 121*a* and 111*a* is outputted via the main passage 131 in the head 13 during the inward stroke of the handle 23, best shown in FIG. 10. Accordingly, high volume/low pressure inflation is achieved. Ambient air enters chamber sections 121*b* and 111*b* during the inward stroke of the handle 23 for subsequent outward stroke of the handle 23.

Figure 11:
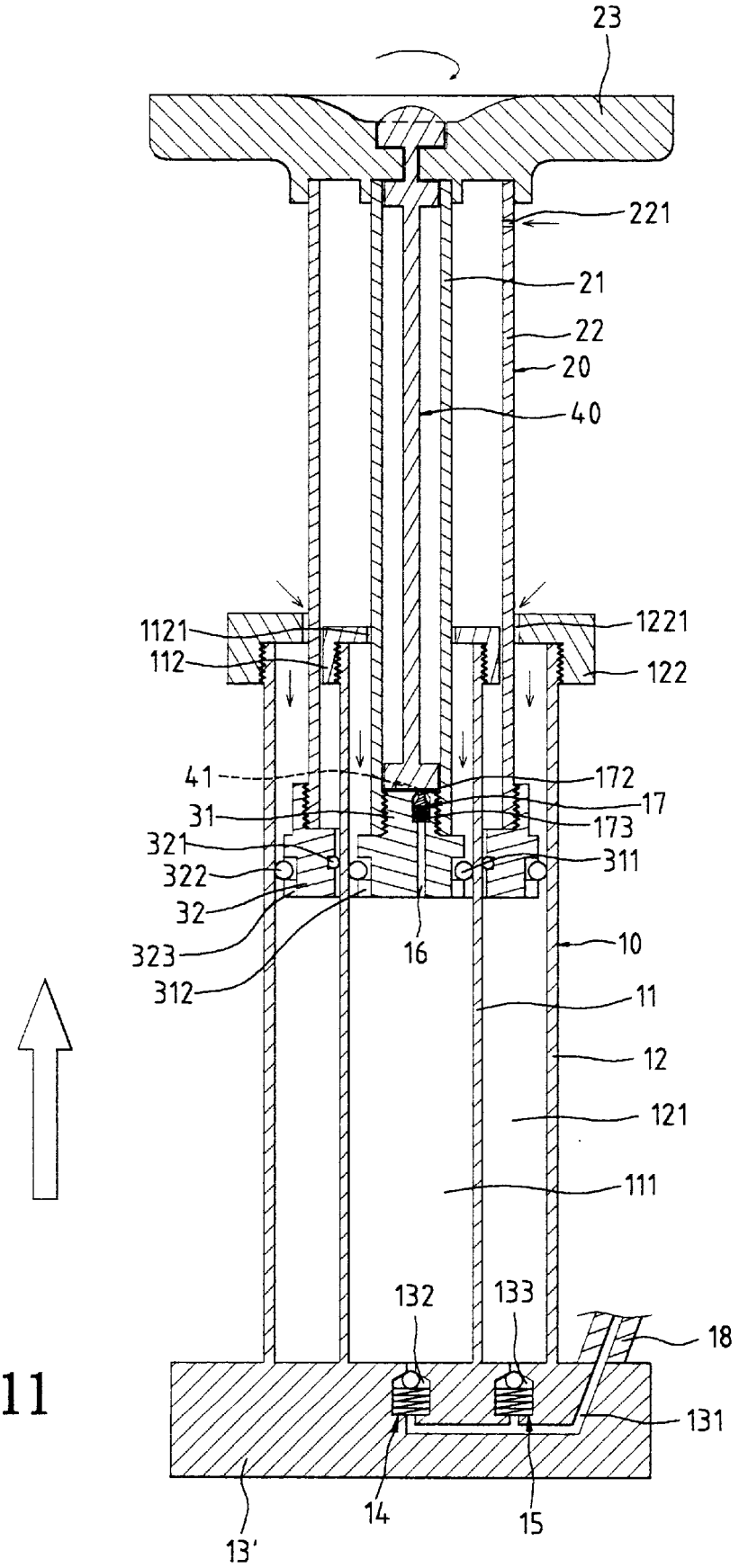
FIG. 11 is a sectional view similar to FIG. 9, wherein the handle of the pump is in an outward stroke for high-pressure pumping.
Figure 12:
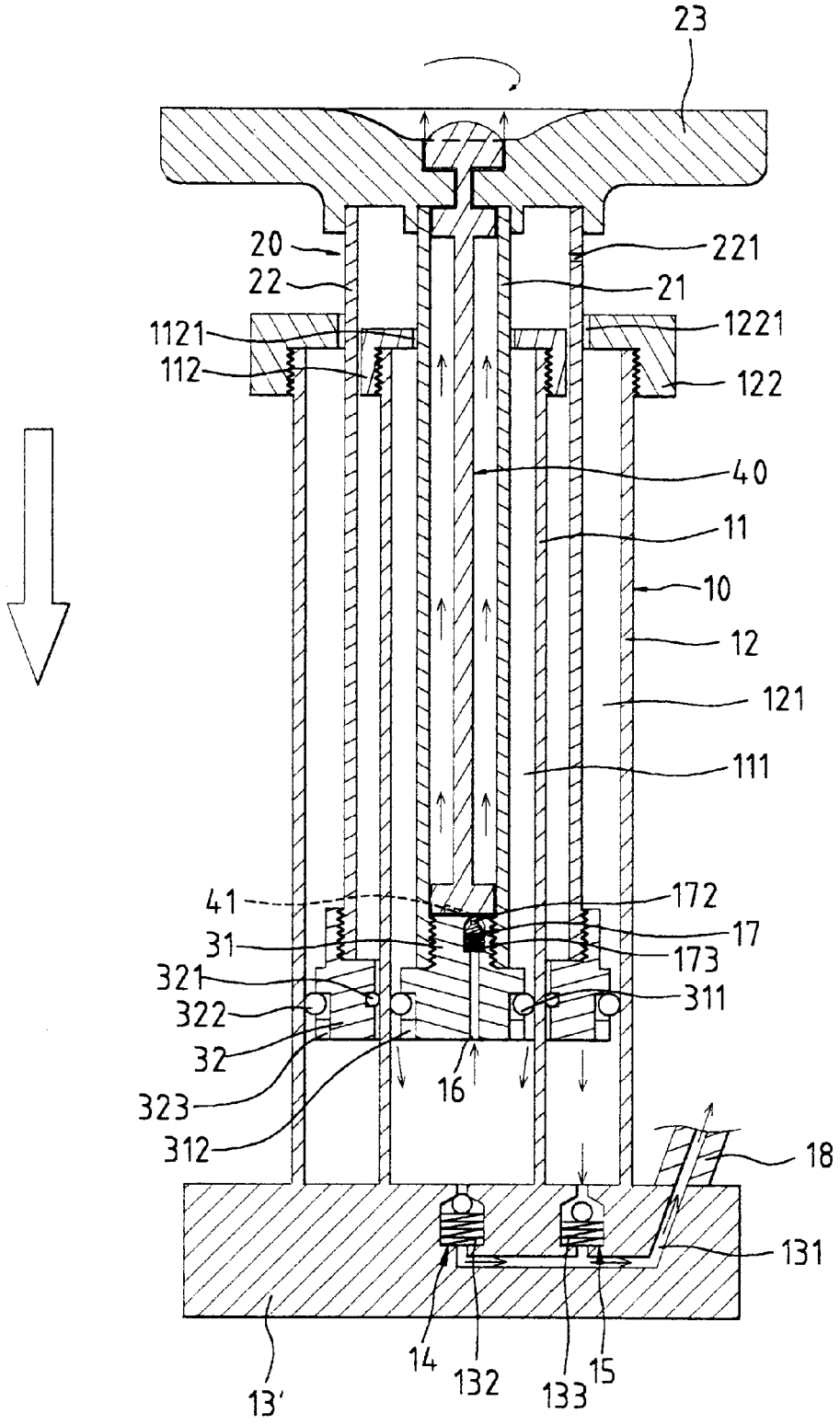
FIG. 12 is a sectional view similar to FIG. 11, wherein the handle of the pump is in an inward stroke for high-pressure pumping.

The switchable valve means 17 of the pump in FIG. 11 is in the second status and the release passage 16 is opened. During the outward stroke of the handle 23, O-ring 322 abuts against the upper edge (lower edge in FIG. 11) of the annular groove 323 and O-ring 311 abuts against the upper edge (lower edge in FIG. 11) of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 11. During the inward stroke of the handle 23, O-ring 322 abuts against the lower edge (upper edge in FIG. 12) of the annular groove 323 and O-ring 311 abuts against the lower edge (upper edge in FIG. 12) of the annular groove 312 such that air is not flowable from chamber sections 121*b* and 111*b* to chamber sections 121*a* and 111*a*. Thus, air in chamber section 121*a* is outputted via the main passage 131 in the head 13 during the inward stroke of the handle 23, best shown in FIG. 12. Nevertheless, air in chamber section 111*a* exits the pump via the valve means 17. Thus, low volume/high pressure inflation is achieved. Ambient air enters chamber sections 121*b* and 111*b* during the inward stroke of the handle 23 for subsequent outward stroke of the handle 23.

Figure 13:
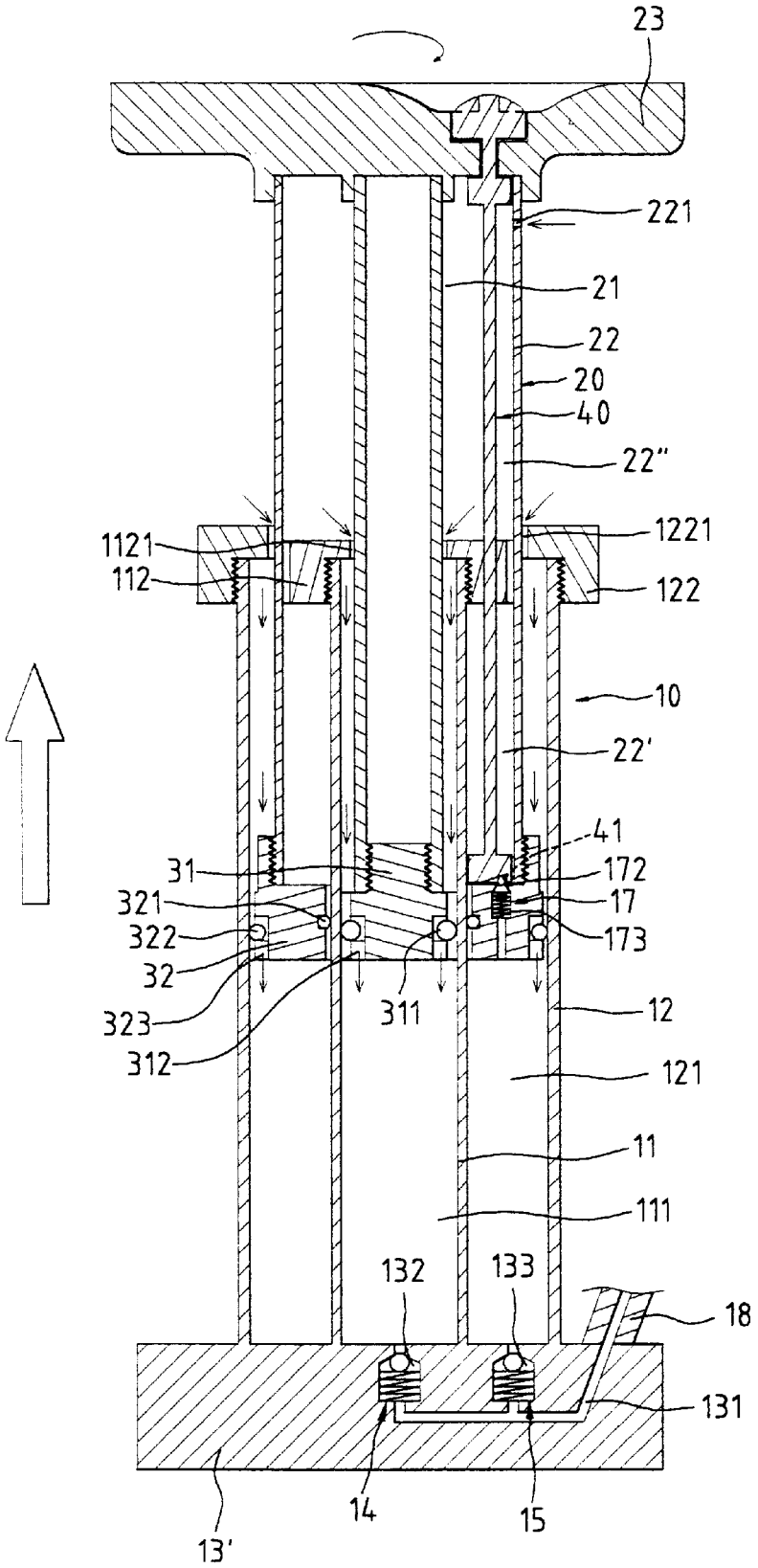
FIG. 13 is a sectional view of a fourth embodiment of the manual air pump in accordance with the present invention, wherein the handle of the pump is in an outward stroke for high-volume pumping.

FIG. 13 illustrates a fourth embodiment of the manual air pump. Structure of the fourth embodiment is substantially the same as that of the third embodiment except for arrangement in the release passage 16 and the valve means 17. In this embodiment, a mediate chamber 22' is defined between the outer piston rod 22 and the inner tube 11. The mediate chamber 22*a* communicates with environment via a chamber 22" defined between the outer piston rod 22 and the inner piston rod 21. The release passage 16 is defined in the outer piston 32 and communicates the third chamber section 121*a* with the mediate chamber 22'. The switchable valve means 17 includes a one-way valve 172 (with an elastic member 173) mounted in the release passage 16 and an operative rod 40 having a first end operably connected to the one-way valve 172 and a second end extended beyond the handle 23 for manual operation. The one-way valve 172 is closed when the operative rod 40 is in a first position. The one-way valve 172 is opened when the operative rod 40 is switched to a second position such that air is only flowable from the third chamber 121*a* to the mediate chamber 22'.

Figure 14:
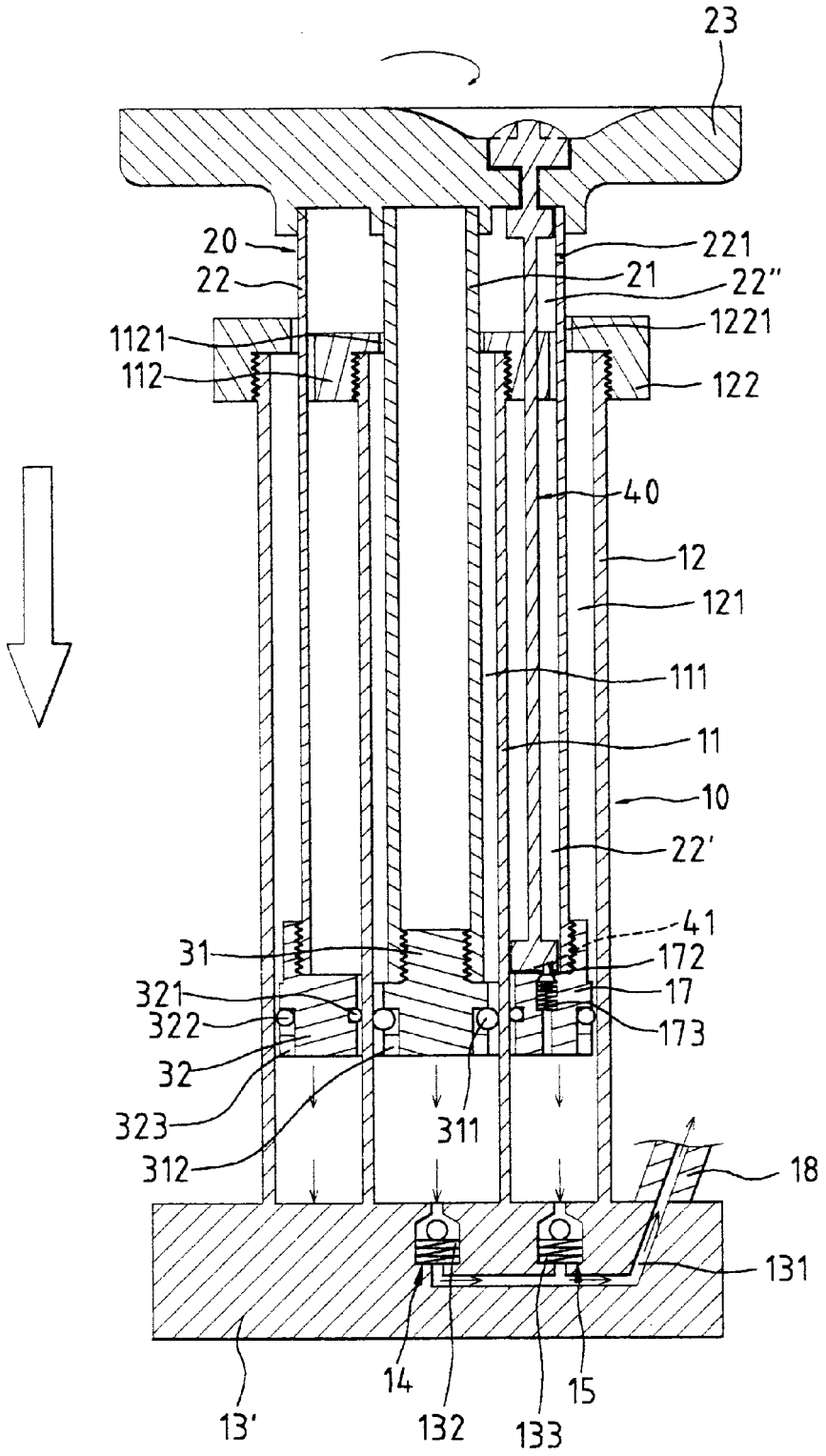
FIG. 14 is a sectional view similar to FIG. 13, wherein the handle of the pump is in an inward stroke for high-volume pumping.

The switchable valve means 17 of the pump in FIG. 13 is in the first status and the release passage 16 is blocked. During the outward stroke of the handle 23, O-ring 322 abuts against the upper edge (lower edge in FIG. 13) of the annular groove 323 and O-ring 311 abuts against the upper edge (lower edge in FIG. 13) of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 13. During the inward stroke of the handle 23, O-ring 322 abuts against the lower edge (upper edge in FIG. 14) of the annular groove 323 and O-ring 311 abuts against the lower edge (upper edge in FIG. 14) of the annular groove 312 such that air is not flowable from chamber sections 121*b* and 111*b* to chamber sections 121*a* and 111*a*. Thus, air in chamber sections 121*a* and 111*a* is outputted via the main passage 131 in the head 13 during the inward stroke of the handle 23, best shown in FIG. 14. Accordingly, high volume/low pressure inflation is achieved. Ambient air enters chamber sections 121*b* and 111*b* during the inward stroke of the handle 23 for subsequent outward stroke of the handle 23.

Figure 15:
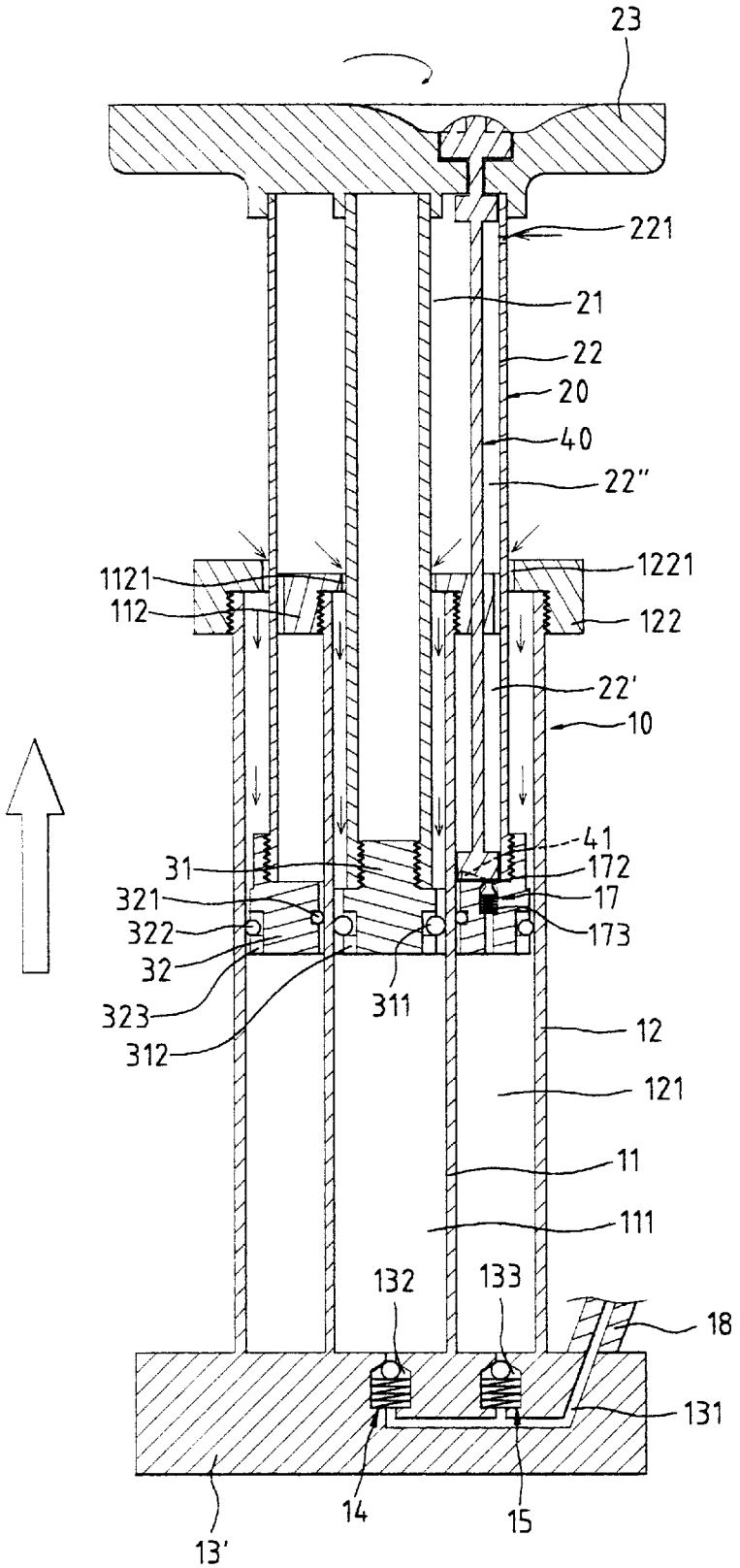
FIG. 15 is a sectional view similar to FIG. 13, wherein the handle of the pump is in an outward stroke for high-pressure pumping.
Figure 16:
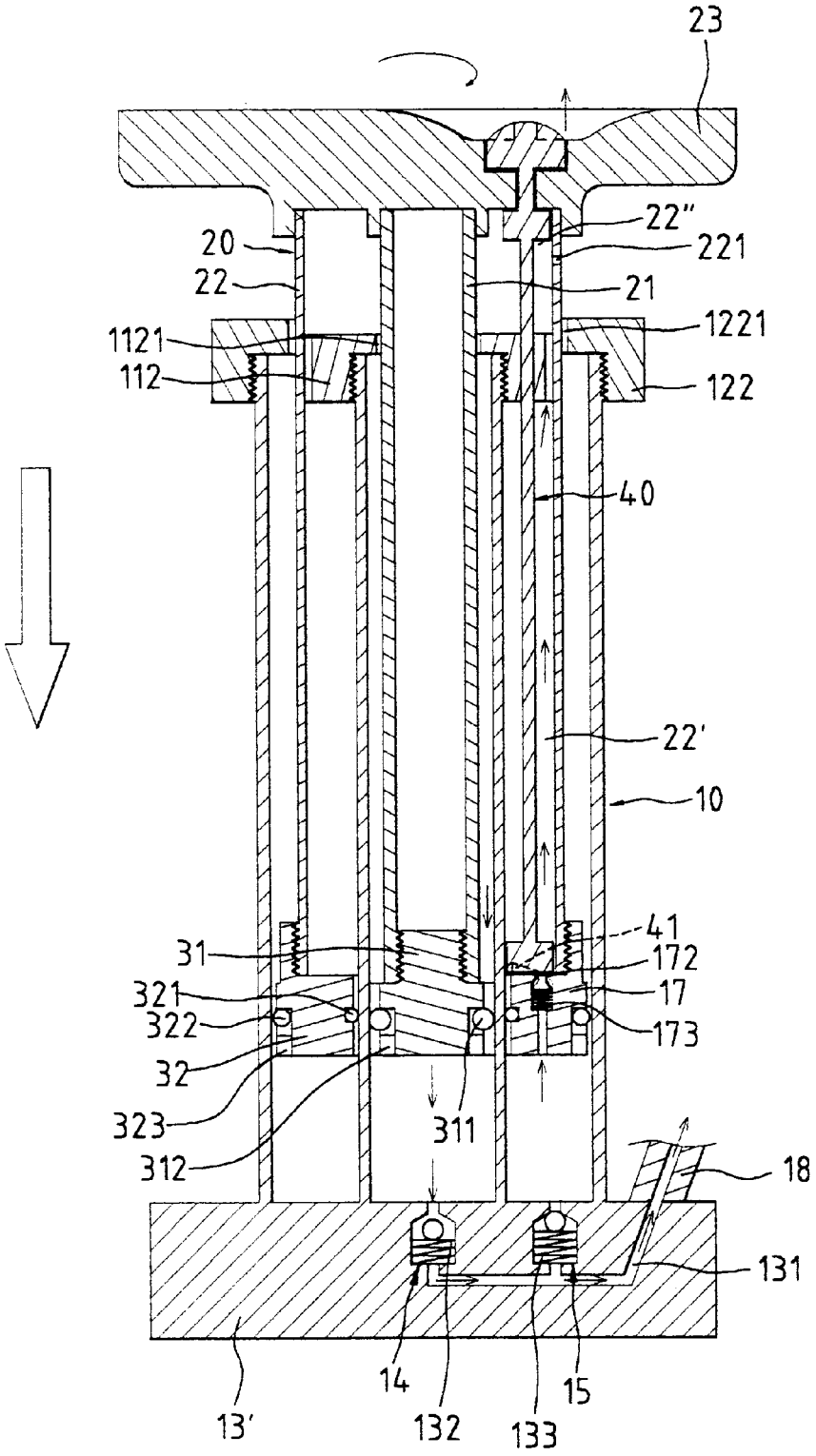
FIG. 16 is a sectional view similar to FIG. 15, wherein the handle of the pump is in an inward stroke for high-pressure pumping.

The switchable valve means 17 of the pump in FIG. 15 is in the second status and the release passage 16 is opened. During the outward stroke of the handle 23, O-ring 322 abuts against the upper edge (lower edge in FIG. 15) of the annular groove 323 and O-ring 311 abuts against the upper edge (lower edge in FIG. 15) of the annular groove 312 such that air is flowable from chamber sections 121*b* and 111*b* to chamber sections 121*a* and 111*a*. In addition, vacuum in chamber sections 121*a* and 111*a* as a result of a previous inward stroke of the handle 23 assists in intake of air. Thus, ambient air enters chamber sections 121*a* and 111*a* during the outward stroke of the handle 23, best shown in FIG. 15. During the inward stroke of the handle 23, O-ring 322 abuts against the lower edge (upper edge in FIG. 16) of the annular groove 323 and O-ring 311 abuts against the lower edge (upper edge in FIG. 16) of the annular groove 312 such that air is not flowable from chambers 121*b* and 111*b* to chamber sections 121*a* and 111*a*. Thus, air in chamber section 111*a* is outputted via the main passage 131 in the head 13 during the inward stroke of the handle 23, best shown in FIG. 16. Nevertheless, air in chamber section 121*a* exits the pump via the valve means 17. Thus, low volume/high pressure inflation is achieved. Ambient air enters chamber sections 121*b* and 111*b* during the inward stroke of the handle 23 for subsequent outward stroke of the handle 23.

According to the above description, reliable dual-mode manual air pumps are provided, and operations therefor are simple.

Although the invention has been explained in relation to its preferred embodiment, it is to be understood that many other possible modifications and variations can be made without departing from the spirit and scope of the invention as hereinafter claimed.

What is claimed is:

1. A manual air pump comprising:

an outer tube including a first end and a second end, an inner tube coaxially mounted in the outer tube and including a first end and a second end, an inner chamber being defined in the inner tube, an outer chamber being defined between the outer tube and the inner tube, a head coupled to the first end of the outer tube and the first end of the inner tube, the head including a main passage communicated with the inner chamber and the outer chamber for supplying air to an object to be inflated, a piston assembly including:

an inner piston rod having a first end with an inner piston slidably received in the inner chamber and a second end, the inner piston separating the inner chamber into a first chamber section adjacent to the head and a second chamber section distal to the head, an outer piston rod having a first end with an outer piston slidably received in the outer chamber and a second end, the outer piston separating the outer chamber into a third chamber section adjacent to the head and a fourth chamber section distal to the head, and a handle secured to the second end of the inner piston rod and the second end of the outer piston rod to move therewith, means for supplying ambient air into the second chamber section and the fourth chamber section during an outward stroke of the handle away from the head, a release passage for communicating one of the first chamber section and the third chamber section with environment, and switchable valve means mounted in the release passage, wherein the release passage is blocked when the switchable valve means is in a first status, and wherein the release passage is opened when the switchable valve means is in a second status such that air is only flowable from said one of the first chamber section and the third chamber section to environment.

2. The manual air pump as claimed in claim 1, wherein the head includes a passage through which air is flowable from the first chamber section to the main passage, and further comprising a one-way valve mounted in the passage such that air is only flowable from the first chamber section to the main passage.

3. The manual air pump as claimed in claim 1, wherein the head includes a passage through which air is flowable from the third chamber section to the main passage, and further comprising a one-way valve mounted in the passage such that air is only flowable from the third chamber section to the main passage.

4. The manual air pump as claimed in claim 1, wherein the inner piston including an annular groove defined in an outer periphery thereof and including a first end edge and a second end edge, an O-ring being mounted in the annular groove and so arranged that an air path is defined to allow air to flow from the second chamber section to the first chamber section when the O-ring abuts against the first end edge of the annular groove as a result of the outward stroke of the handle away from the head and that the air path is blocked when the O-ring abuts against the second edge of the annular groove as a result of an inward stroke of the handle toward the head.

5. The manual air pump as claimed in claim 1, wherein the outer piston includes an annular groove defined in an outer periphery thereof and having a first end edge and a second end edge, an O-ring being mounted in the annular groove and so arranged that an air path is defined to allow air to flow from the fourth chamber section to the second chamber section when the O-ring abuts against the first end edge of the annular groove as a result of the outward stroke of the handle away from the head and that the air path is blocked when the O-ring abuts against the second end edge of the annular groove as a result of an inward stroke of the handle toward the head.

6. The manual air pump as claimed in claim 1, wherein the release passage is defined in the head and communicates the first chamber section with environment.

7. The manual air pump as claimed in claim 6, wherein the switchable valve means includes a one-way valve and an elastic member mounted in the release passage and a manually operable switch key for switching the switchable valve means between the first status and the second status.

8. The manual air pump as claimed in claim 6, wherein the air supplying means includes a first passage defined between the second end of the outer tube and the outer piston rod, a second passage defined between the second end of the inner tube and the inner tube, and an opening defined in the second end of the outer piston rod.

9. The manual air pump as claimed in claim 1, wherein the outer tube includes an extension tube extended from an outer periphery thereof, the release passage is defined in the extension tube that communicates the third chamber section with environment.

10. The manual air pump as claimed in claim 9, wherein the switchable valve means includes a one-way valve and a first elastic member mounted in the extension tube, a sleeve mounted around the extension tube and enclosing a distal end of the extension tube, and a valve stem slidably received in the extension tube and having an end extended beyond the sleeve for manual operation between the first status and the second status, the sleeve further including a notch, the valve stem including a block, wherein the notch of the sleeve is blocked by the block of the valve stem when the switchable valve means is in the first status such that air in the fourth chamber section is not flowable to environment, and wherein the notch is not blocked by the block of the valve stem when the switchable valve means is in the second status such that air in the fourth chamber section is flowable to environment during an inward stroke of the handle.

11. The manual air pump as claimed in claim 9, wherein the air supplying means includes a first passage defined between the second end of the outer tube and the outer piston rod, a second passage defined between the second end of the inner tube and the inner tube, and an opening defined in the second end of the outer piston rod.

12. The manual air pump as claimed in claim 1, wherein the inner piston rod includes a hollow interior communicated with environment, and the release passage is defined in the inner piston and communicates the first chamber section with the hollow interior of the inner piston rod, and the switchable valve means includes a one-way valve mounted in the release passage and an operative rod having a first end operably connected to the one-way valve and a second end extended beyond the handle for manual operation, wherein the one-way valve is closed when the operative rod is in a first position, and wherein the one-way valve is opened where the operative rod is in a second position such that the hollow interior of the inner piston rod communicates with environment and that air is only flowable from the first chamber section to the hollow interior of the inner piston rod.

13. The manual air pump as claimed in claim 12, wherein the air supplying means includes a first passage defined between the second end of the outer tube and the outer piston rod, a second passage defined between the second end of the inner tube and the inner tube, and an opening defined in the second end of the outer piston rod.

14. The manual air pump as claimed in claim 1, wherein a mediate chamber is defined between the outer piston rod and the inner tube, the mediate chamber being communicated with environment via a chamber defined between the outer piston rod and the inner piston rod, wherein the release passage is defined in the outer piston and communicates the third chamber section with the mediate chamber, and the switchable valve means includes a one-way valve mounted in the release passage and an operative rod having a first end operably connected to the one-way valve and a second end extended beyond the handle for manual operation, wherein the one-way valve is closed when the operative rod is in a first position, and wherein the one-way valve is opened when the operative rod is in a second position such that air is only flowable from the third chamber to the mediate chamber.

15. The manual air pump as claimed in claim 14, wherein the air supplying means includes a first passage defined between the second end of the outer tube and the outer piston rod, a second passage defined between the second end of the inner tube and the inner tube, and an opening defined in the second end of the outer piston rod.

* * * * *